US009546063B2

(12) United States Patent
Ormaechea Saracibar et al.

(10) Patent No.: US 9,546,063 B2
(45) Date of Patent: Jan. 17, 2017

(54) PRINTING MEDIA

(71) Applicant: Hewlett-Packard Development Company, L.P., Houston, TX (US)

(72) Inventors: Joseba Ormaechea Saracibar, Barcelona (ES); Aviv Hassidov, Barcelona (ES); Eduardo Martin Orue, Sabadell (ES); Josep Luis Molinet Munar, Barcelona (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/168,780

(22) Filed: Jan. 30, 2014

(65) Prior Publication Data

US 2015/0210492 A1 Jul. 30, 2015

(51) Int. Cl.

| | |
|---|---|
| ***B41F 33/00*** | (2006.01) |
| ***B65H 7/02*** | (2006.01) |
| ***B65H 1/02*** | (2006.01) |
| ***B65H 3/68*** | (2006.01) |
| ***B41J 13/10*** | (2006.01) |

(52) U.S. Cl.

CPC ..... *B65H 7/02* (2013.01); *B41J 13/106* (2013.01); *B65H 1/02* (2013.01); *B65H 3/68* (2013.01); *B65H 2405/324* (2013.01); *B65H 2407/21* (2013.01)

(58) Field of Classification Search

CPC ..... B65H 2301/3122; B65H 2301/3121; B65H 2301/3123; B65H 2301/5121; B65H 2601/325; B65H 2407/21; B65H 2405/10; B65H 2405/20; B65H 2405/21; B65H 2405/211; B65H 2405/2111; B65H 2405/22; B65H 2405/221;B65H 2405/313; B65H 2405/312; B65H 2801/36; B65H 2701/11312; B65H 31/22; B65H 31/40; B65H 54/76; B65H 2301/16; B65H 2301/4224; B65H 1/02; B65H 2405/3312; B65H 2405/33; B65H 2405/332; B41J 11/38; B41J 13/10; B41J 13/103

See application file for complete search history.

(56) References Cited

U.S. PATENT DOCUMENTS

| | | | | |
|---|---|---|---|---|
| 5,012,295 | A * | 4/1991 | Ikkatai et al. | 399/384 |
| 5,190,167 | A * | 3/1993 | Andrews | B65H 31/24 211/50 |
| 2006/0214351 | A1* | 9/2006 | Watanabe | 271/3.14 |

FOREIGN PATENT DOCUMENTS

JP 08091663 A * 4/1996

OTHER PUBLICATIONS

"HP Designjet T920 and T1500 ePriner Series—Using the stacker", Download Date: Jan. 30, 2014, pp. 1-5. <http://h20565.www2.hp.com/portal/site/hpsc/template.PAGE/public/psl/mostViewed-Display/?sp4ts.oid=5365093&spf_p.tpst=psiContentDisplay&spf_p.prp_psiContentDisplay=wsrp-navigationalState%3DdocId%253Demr_na-c03808467-2%257CdocLocale%253Den_US&javax.portlet.begCacheTok=com.vignette.cachetoken&javax.portlet.endCacheTok=com.vignette.cachetoken>.

* cited by examiner

*Primary Examiner* — Matthew G Marini
(74) *Attorney, Agent, or Firm* — HP Inc—Patent Department

(57) ABSTRACT

An example method for printing in accordance with the present disclosure is provided. The method comprises detecting a selection of a manual mode for a print job, detecting that a stacker is in a manual mode condition, (Continued)

printing the print job and outputting the print job to the stacker.

17 Claims, 6 Drawing Sheets

PRINTING MEDIA

BACKGROUND

Printers, for example large format printers, may have a number of different output supports for the printed media, such as baskets, bins and/or stackers.

When printing on photographic media or other glossy media, often a user remains near the printing apparatus in order to make sure the printing process and media output proceed as desired and the printed jobs are undamaged, especially if high quality images have to be obtained.

BRIEF DESCRIPTION

Figure 1:
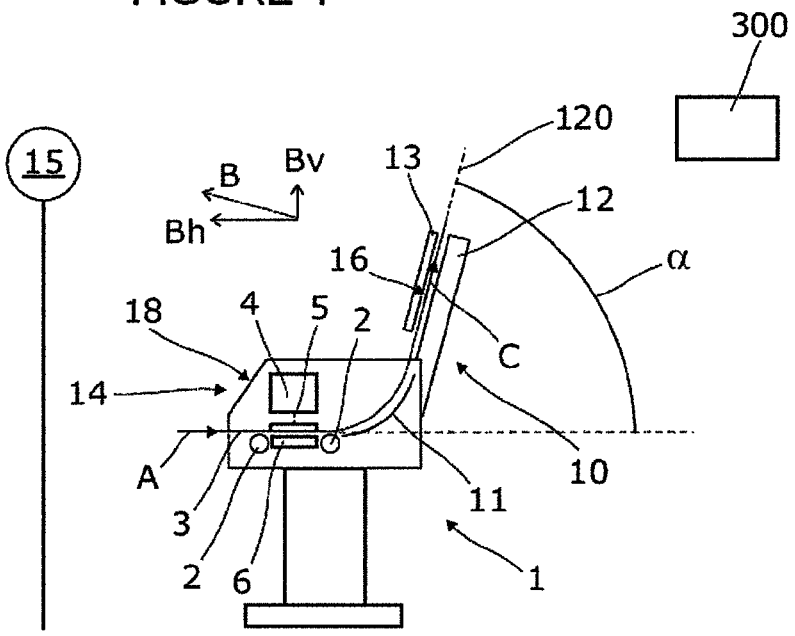
Figure 2:
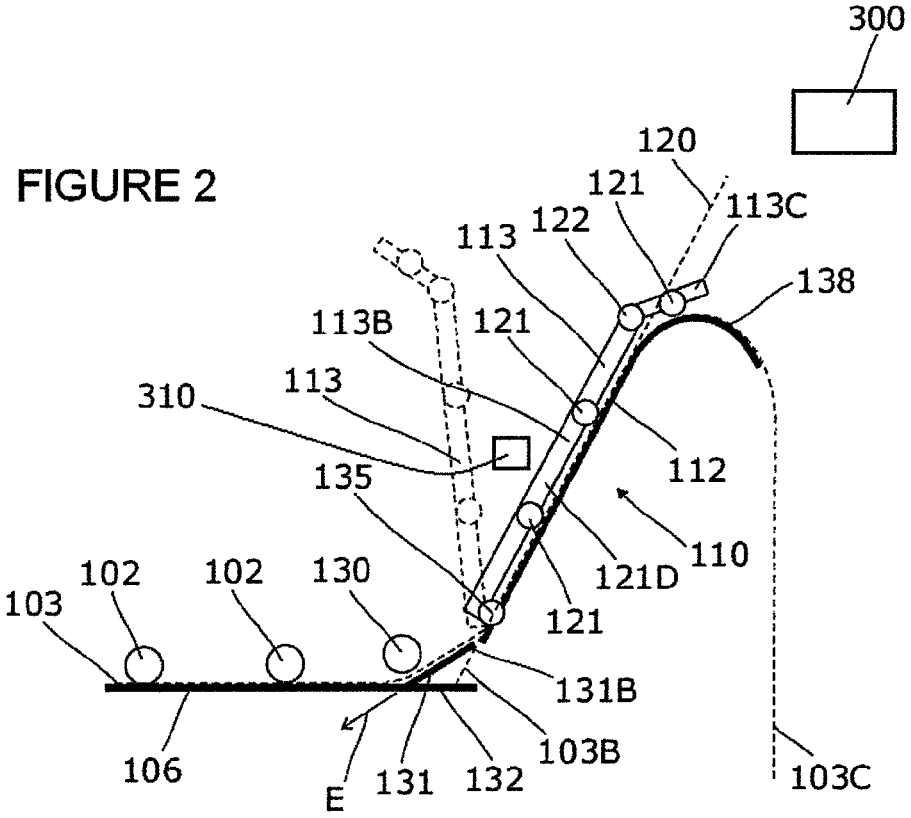
Figure 3B:
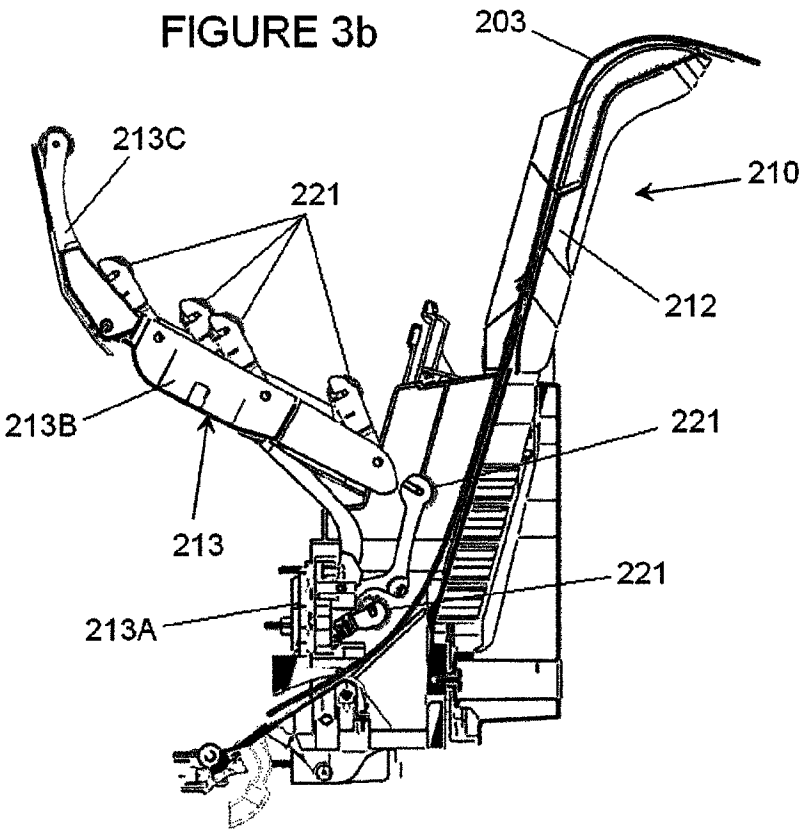
Figure 3A:
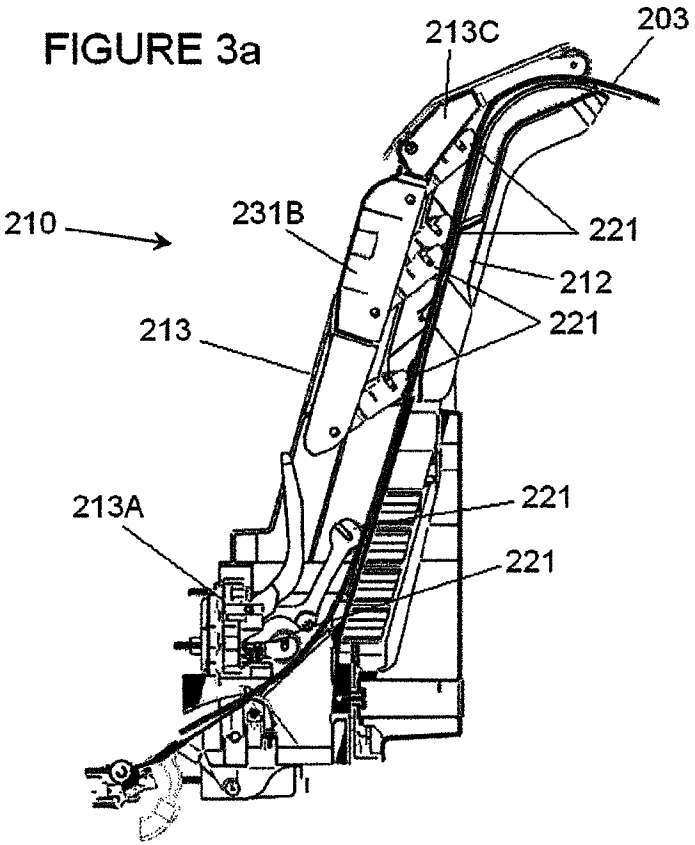

Some non-limiting examples according to the teachings of this disclosure will be described in the following with reference to the appended drawings, in which:

FIG. 1 illustrates a diagram of an example of a printing apparatus;

FIG. 2 schematically shows an example of a part of a printing apparatus with a non-horizontal stacker;

FIGS. 3*a* and 3*b* show an example of a non-horizontal stacker in two positions; and FIGS. 4 to 11 illustrate flowcharts of example methods of printing as provided herein.

DETAILED DESCRIPTION

In the following detailed description reference is made to the appended drawings. The description and drawings should be considered purely illustrative and non-limiting to the specific example or implementation described.

Printing on photographic media may involve considering particular factors, especially if high quality is desired, because the printed plot may become damaged if it comes into contact with elements such as printer parts or other media sheets, or if it coils or rolls up on itself. This may occur, for example, if the printed media is outputted to the baskets or bins associated with some commercially available printers.

Some printers may be provided with a stacker, which allows stacking sheets of media or media plots cut from a roll and therefore preventing the media from coiling. Some printing apparatus, for example some large format printers, comprise non-horizontal stackers, which save floor space with respect to a horizontal stacker.

Non-horizontal stackers may have a ramp and an inclined stacker support to receive the media, and guiding elements, which may be active or passive, such as ribs, steel wires, belts, wheels, rollers or the like, which may contact the printed side of the media in order to guide the media advance in the upwards direction.

FIGS. 1 and 2 show examples of printing systems provided with a non-horizontal stacker.

FIG. 1 illustrates a diagrammatic side view of a printing system, such as a large format printer 1. The printer 1 includes a media advance system 2, for advancing large format media 3 in a first direction A, under a printhead 4, for printing. The first direction A can be horizontal. In the drawing the media advance system is schematically illustrated by two drive wheels 2. In other examples the media advance system includes a transmission, gears and pinch wheels. The printhead 4 can be a scanning printhead or a page wide array of printheads, each printhead including ink ejection nozzle arrays. For example the printer 1 is to print on large format media 3 having a width of at least approximately 59 centimeters, for example at least A1 format. It is to be understood that a "width" of the media 3 would extend perpendicular into the drawing of FIG. 1, and is therefore not illustrated. The printer 1 includes a print zone 5, which can be defined as the zone wherein the printhead 4 is to transfer ink. The print zone 5 may be defined by a swath of a scanning printhead, or by dimensions of a page wide array of printheads. For example the printhead 4 covers the print zone 5 having a longest dimension of at least approximately 59 centimeters. For example the length of the print zone 5 corresponds to a maximum media width. The printer 1 includes a print platen 6, arranged in or near the print zone 5, under the printhead 4, for supporting the media during printing. For example, the media 3 is advanced in a horizontal direction A in the print zone 5, over the print platen 6.

The printer 1 includes a stacker 10 for stacking printed large format media 3. In the illustrated example the stacker 10 is fixed to the printer 1, allowing inline stacking of the media 3 during printing. The stacker 10 is arranged downstream of the printhead 4. The media advance system 2 advances the media 3 to the stacker 10.

The stacker 10 may also be associated with a different kind of printing apparatus, for example a large format LED printer, with a different printing technology (LED Dry Electro Photography), but in which the print media circulation is similar to what is described above.

The stacker 10 includes a ramp 11 to curve printed media 3. The stacker 10 includes an inclined stacker support 12 to receive the media 3 from the ramp 11 and stack the media 3. The ramp 11 is arranged at the bottom of the support 12. The support 12 supports the backside of the media 2. The stacker 10 further includes a top guide 13, positioned opposite to the support 12, to guide the large format media 3 on the printed side or image side of the media 3. For example the top guide 13 engages the image side of the media 3 without smearing the printed image, even when the printed image is not fully dried. For example, the stacker 10 may have a width of at least 59 centimeters, and correspondingly the support 12 and top guide 13 may have width of at least 59 centimeters, corresponding to the maximum media width and print zone length.

For example the ramp 11 receives incoming printed media 3 and guides the printed media 3 to the stacker support 12. The ramp 11 curves the printed media 3 over an angle $\alpha$ of between approximately 20 and approximately 90 degrees with respect to the first direction A, or for example between approximately 20 and approximately 85 degrees. In the illustrated example, the ramp 11 curves the media 3 over an angle $\alpha$ of approximately 70 to 80 degrees, for example close to 75 degrees. Accordingly, the support 12 allows for supporting and advancing the stacked media under said angle $\alpha$ of between approximately 20 and approximately 90 degrees, or for example between approximately 20 and approximately 85 degrees, for example between approximately 70 and approximately 80 degrees, or for example close to 75 degrees.

For example, by stacking the printed media 3 having an inclination a with respect to the media advance direction or horizontal A of approximately 20 to 90 degrees, a printed image 16 on stacked media 3 conveniently faces an operator 15, allowing the operator 15 to view the printed image 16 during printing, as it advances over the support 12. For example, the printed image 16 faces towards the front side 14 of the printer 1, as illustrated by a horizontal component Bh of the image facing direction B. For example, the image also faces upwards, as illustrated by a vertical component By of the image facing direction B. For example the front side 14 of the printer 1 can be defined as the side of the printer 1 where an operator panel 18 is located, or where a media input of the printer 1 is located.

The top guide 13 guides the media 3 along its printed top surface 16 while it advances over the stacker 10. For example, the top guide 13 prevents buckling or curling of the media 3 while it advances over the previously stacked media 3 on the support 12. For example, relatively thin large format media that is wet after printing may tend to buckle or curve when advancing over the support 12, in an upwards direction C, or for example thick large format media can tend to bend or buckle under its own weight. For example, the printer 1 allows for relatively thin and flexible media and can allow installation of a 2 inch media roll. The top guide 13 can guide and flatten the media 3 while it advances in the stacker 10 and prevent bending, buckling, curving, or other deformations.

The printing system of FIG. 1 may comprise a controller 300.

FIG. 2 illustrates another example of a printer, showing a portion of the printer including a platen 106, media advance system 102 and a stacker 110. The media advance system 102 is schematically illustrated by two guide wheels 102. The printer includes a stacker input drive 130 to advance media 103 into the stacker 110, the stacker input drive 130 schematically illustrated by a wheel.

The printer includes a bridge 131. For example the bridge 131 is retractable. For example in the extended position an extreme 131B of the bridge 131 retains the media stack near its foot 103B of the media stack. In the extended position, the bridge 131 is to guide the media 103 during printing over a foot 103B of the media stack. For example, the bridge 131 guides the media 103 into the stacker 110 without interference with the bottom edges of the pre-stacked media.

For example, the bridge 131 is retractable in a direction E away from the stacker support 112. For example, the bridge 131 may be retracted after a trailing edge of the advancing printed media 103 has passed the bridge 131, or at the moment the trailing media edge is about to pass the bridge 131. As the bridge 131 retracts, the printed media 103 slides downwards, until it rests onto a media stack foot support 132 of the stacker 110. The stack foot support 132 is arranged under the bridge 131, at least in an extended position of the bridge 131. For example, the stack foot support 132 includes a tray or gutter for supporting stacked media at the foot 103B.

For example, the stacker support 112 for advancing and supporting a back of the media 103 includes a curved upper portion 138, for curving the media 103 downwards over the top of the stacker 110 so that part 103C of the media stack hangs down over the stacker, while reducing the risk of folding or buckling.

The printer includes a top guide 113. In FIG. 2 the top guide 113 is illustrated in a closed position by normal lines, and in an open position by ghost lines. For example the top guide 113 includes a first hinge 135 to hinge the top guide 113 with respect to the support 112. The first hinge 135 allows the top guide 113 to be opened with respect to the support 112, facilitating convenient release of the media stack from the stacker 110 when the top guide 113 is in open position.

For example, the top guide 113 includes top guide elements 121 to engage media 103 in a single plane 120, parallel to a support surface of the support 112. For example, the top guide elements 121 aid in maintaining a relatively flat shape of the media 103 advancing over the support 112, preventing buckling, curving, etc. For example, the top guide elements 121 engage the printed image side of the media 103. For example, the top guide elements 121 are regularly distributed over the support plane, for example for optimal guidance and flattening of the media 103. For example, the top guide elements 121 comprise passive wheels. For example, the top guide elements 121 include star wheels or rubber wheels to avoid marks on printed media that is not fully dry.

For example, the top guide 113 includes a top guide base portion 113B and an upper top guide portion 113C. For example, the top guide 113 includes a second hinge 122 for hinging the upper top guide portion 113C with respect to the top guide base portion 1138. For example, the second hinge 122 is positioned near the curved upper portion 138 of the support 112, that is, in a closed position of the top guide 113, to allow the top guide 113 to adapt to the shape of the support 112 near the curved upper portion 138. For example, the upper top guide portion 113C hinges towards the support 112 over the second hinge 122 to engage the media on the curved upper portion 138. For example the second hinge 122 also allows for hinging the upper top guide portion 113C away from the support 112 to take out media from the stacker 110 without needing to open the entire top guide 113 about the first hinge 135.

A printing system such as the printer of FIG. 2 may comprise a controller 300, and may comprise a sensor 310 to detect that the top guide 113 of the stacker 110 is in an open position such as shown in ghost lines.

FIGS. 3*a* and 3*b* show an implementation of a non-horizontal stacker. In FIG. 3*a*, a stacker 210 is shown in a normal operating position. The stacker 210 may comprise a stacker support 212 and a top guide 213, which in the example shown has a base top guide portion 213A that is fixed with respect to the support 212, an intermediate top guide portion 213B hinged to the fixed portion 213A, and an upper top guide portion 213C hinged to the intermediate top guide portion 213B. The top guide 213 may comprise top guide elements 221 which may engage the printed side of a media 203 that is outputted to the stacker 210.

In FIG. 3*b*, the example stacker 210 is shown with the top guide 203 in open position. In this position, the top guide elements 221 are raised above a media advance path, and don't contact the printed side of the media 203.

In some implementations, top guide elements 221 that are mounted in the fixed base top guide portion 213A may be moved with respect to said base top guide portion 213A, and raised to the position above the media advance path, for example, by providing a mechanical drive linking them to the movement of the intermediate top guide portion 213B of the top guide 213.

Examples of methods for printing are disclosed in the following, with reference to FIG. 4. Some examples and implementation of methods for printing may be carried out in printing systems such as those of FIG. 1, 2 or 3*a* and 3*b*.

Figure 4:
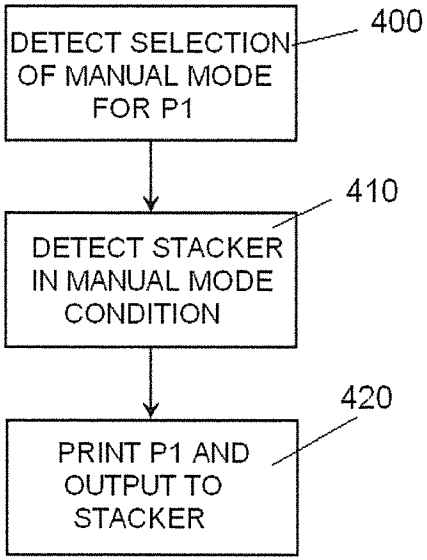

FIG. 4 illustrates a flow chart of an implementation of a method for printing, which may be used for example for printing on large format media.

For example, implementations of the method may comprise detecting a selection of a manual mode for a print job P1, in block 400.

The manual mode may comprise a printing mode in which before, during or after printing, a user performs an action directly on the printing apparatus, and not through a user interface. Such an action may involve, for example, changing the position or configuration of the stacker or parts thereof, confirming through a control panel an operation to be performed, or withdrawing printed media from the stacker.

In some implementations, the manual mode for a print job P1 may be detected by detecting that a user has selected the manual mode via a user interface device.

In some implementations, a predetermined kind of print media, such as photographic paper or other glossy print media, may be associated with the manual mode, for example in the software of the printing apparatus. When a user selects the predetermined kind of print media for the print job P1 via a user interface device, this may lead to detect that a manual mode is selected for said print job P1.

The method may then comprise detecting that a stacker of a printing apparatus is in a manual mode condition, in block 410.

The stacker may be a non-horizontal stacker such as for example stackers 10 or 110 or 210 of FIG. 1, 2 or 3*a* and 3*b*.

A manual mode condition of the stacker may be a condition in which the configuration and/or position of the stacker or parts thereof are suitable for avoiding damage to the printed side of a printed media advancing in the stacker, for example a glossy media.

For example, in a manual mode condition of some implementations of a stacker, media guiding wheels or rollers of the stacker that may contact the printed side of the printed media are raised with respect to the media advance path such that they do not contact the printed side of the print media.

For example, a manual mode condition of example stackers such as stacker 110 shown in FIG. 2 may involve that the top guide 113 is in the open position, i. e. the position schematically shown in ghost lines in FIG. 2. Similarly, FIG. 3*a* may represent the stacker 210 in a normal operating condition, while FIG. 3*b* may represent the stacker 210 in a manual mode condition, wherein top guide elements 212 are in a position in which the top guide elements 212 do not contact the media 203 advancing through the stacker 210.

Once the manual mode condition of the stacker is detected, the print job P1 may be printed, and outputted to the stacker, in block 420.

Implementations of methods for printing according to this disclosure may facilitate using stackers, including non-horizontal stackers, as a media output when printing on photographic or other glossy print media, while reducing the risk of damage to the plot and/or allowing obtaining high quality images.

A printing apparatus operating with some examples of the method disclosed may thus have a relatively simple media output structure, and at the same time it may be versatile and support printing on photographic media.

Figure 5:
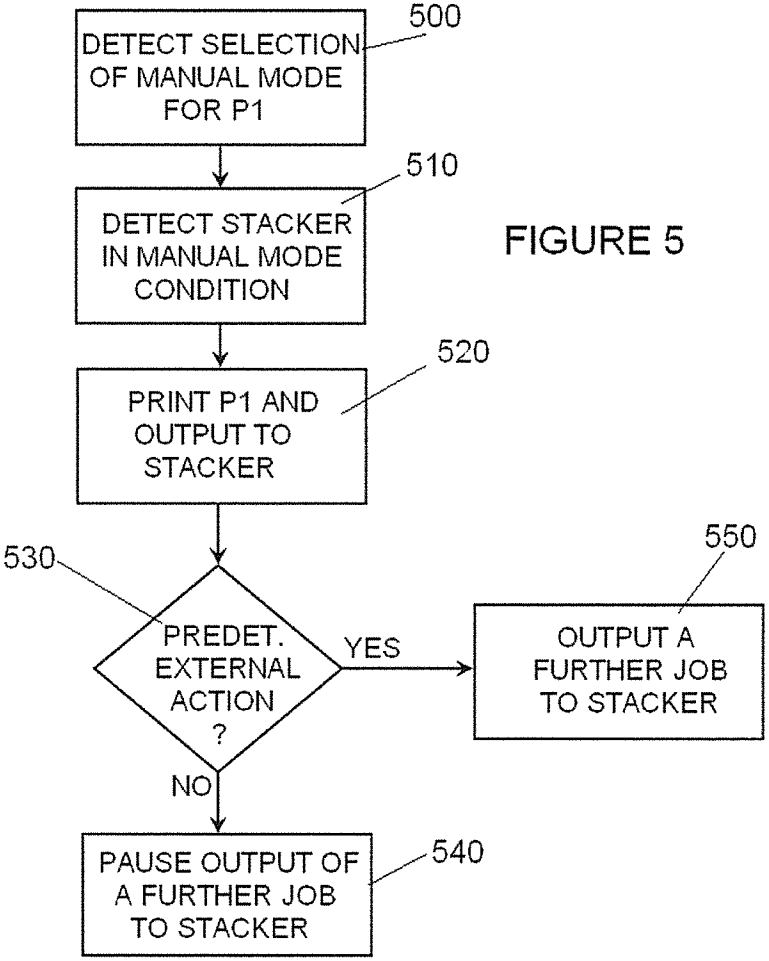

Some implementations of the method, such as shown in the flowchart of FIG. 5, comprise detecting that a manual mode is selected for a print job P1 in block 500, detecting that a stacker is in manual mode condition in block 510, printing and outputting print job P1 to the stacker, in block 520, and then verifying in block 530 if a predetermined external action is detected.

If no such action is detected, in some implementations, as shown in block 540 the system pauses output of a further print job to the stacker, i.e. it does not output to the stacker a further print job that may have been sent to the printing apparatus. The system may for example output a further print job to an alternative printing apparatus output, such as a basket or bin.

The risk may thus be reduced that a print job outputted to the stacker when the latter is in manual mode condition is damaged by later print jobs.

In some other implementations, if a predetermined external action is not detected in block 530, the system pauses printing a further print job, i.e. it does not print a further print job that may have been sent to the printing apparatus. For example the system may hold such a job in a job queue.

In implementations of methods disclosed herein, a predetermined external action may be an action that is not generated by the system itself, for example an action performed by a user. In some implementations, the predetermined external action may be the withdrawal of the printed plot P1 from the stacker, which may be detected by providing a sensor in the stacker.

A predetermined external action may also be the reversal of the manual mode condition of the stacker. For example, in the case of stackers 110 or 210 discussed above, the external action may involve that a user manually closes the top guide 113 or 213, thus reverting from a manual mode condition to a normal condition of the stacker as shown in solid lines in FIG. 2, or in FIG. 3*a*.

A further example of a preliminary external action is an order by a user to end the manual mode via a user interface device, such as a control panel in the printing apparatus or a graphic user interface. A user may perform such an action after withdrawing the printed job P1 from the stacker and placing the stacker back in a normal condition.

In some implementations of a method for printing, a warning that the stacker is in the manual mode condition may be issued if a predetermined external action is not detected after a predetermined time lapses since the print job P1 is printed and outputted to the stacker.

The warning may be issued in several different ways such as for example as a message displayed on a user screen and/or in a display in the printing apparatus, and/or by means of an acoustic signal, or other.

Once a predetermined external action is detected, according to some implementations, as shown in block 550, a further print job that has been received and printed may be outputted to the stacker.

In other implementations, a further print job that has been received and held in a print queue before the predetermined external action was detected, may be printed.

In some implementations, a combination of two or more predetermined external actions, such as for example both the withdrawal of the printed job P1 and an order received via a user interface, may be required in order to continue printing or to continue outputting print jobs to the stacker.

Figure 6:
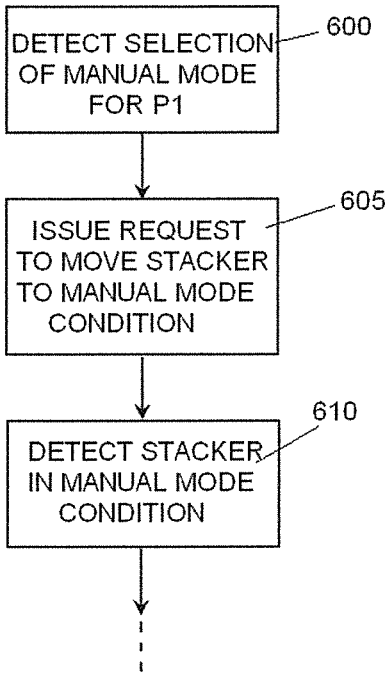

Examples of methods for printing may comprise, as shown in FIG. 6, detecting that a manual mode is selected for a print job P1 in block 600, and then in block 605 issuing a request to a user to move the stacker to a manual mode condition. This may be done is a number of ways including for example by displaying a visual message in a display in the printing apparatus and/or on a user screen, by an acoustic signal, or the like.

After a user moves the stacker to the manual mode condition, for example by opening the top guide 113 of stacker 110 in the case of a printing apparatus such as that of FIG. 2, or the top guide 213 of stacker 210 if the printing apparatus has a stacker such as that of FIGS. 3*a* and 3*b*, operation proceeds to detecting that the stacker is in a manual mode condition (block 610) and continuing with the printing and outputting operations of P1, for example as in block 420 of FIG. 4 or as in block 520 and subsequent of FIG. 5.

Figure 7:
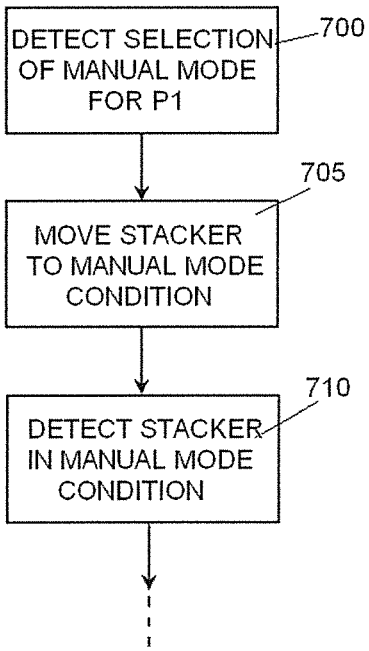

Further examples of methods as disclosed herein for printing are described in the following with reference to FIG. 7. In such examples, after detecting that a manual mode is selected for a print job P1 in block 700, the stacker is moved to a manual mode condition in block 705, for example by activating a motor, a linear actuator, or any other kind of driving element provided for this function in the printing apparatus. Operation then proceeds in block 710 to detecting that the stacker is in a manual mode condition, and then continuing with the printing and outputting operations of P1.

In some implementations, detecting that a stacker is in a manual mode condition may comprise detecting that guiding elements that are intended for contacting and guiding the printed side of printed media during advance through the stacker, such as for example the top guide elements 121 in FIG. 2 or the top guide elements 212 in FIGS. 3*a* and 3*b*, are spaced apart from the print media advance path, i.e. they are in a position in which they do not contact the media that may advance through the stacker.

In some implementations, for example when the method is performed in a printing apparatus with a stacker such as for example the one schematically shown in FIG. 2 or in FIGS. 3*a* and 3*b*, the detection that guiding elements of the stacker for contacting and guiding the printed side of printed media are spaced apart from a print media advance path may comprise detecting that a top guide of the stacker which bears the guiding elements is in an open position, such as that shown in ghost lines in FIG. 2, or that shown in FIG. 3*b*.

Figure 8:
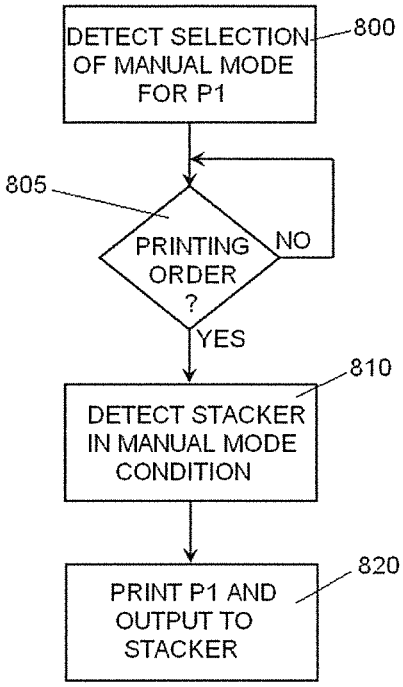
Figure 9:
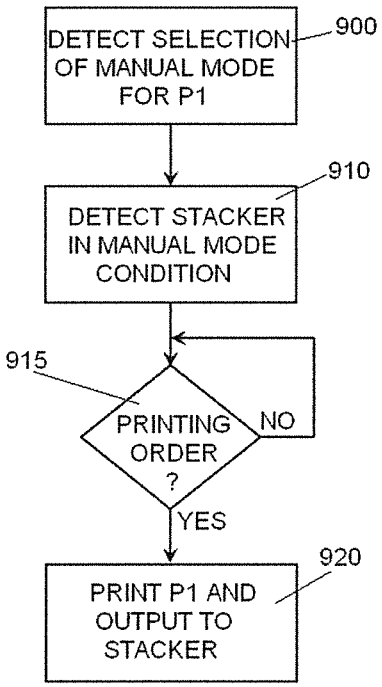

Some further particular implementations of a method for printing may comprise, after detecting that a manual mode is selected for a print job, waiting for a printing order from a user via a user interface device before printing the print job. FIGS. 8 and 9 show examples of such implementations.

In FIG. 8, after detecting that a manual mode is selected for a print job P1, in block 800, the system waits for a printing order via a user interface device, in block 805, and once this order is received it proceeds to detecting that the stacker is in a manual mode condition, in block 810, and to the printing and outputting operations of P1, in block 820.

In FIG. 9, after detecting that a manual mode is selected for a print job P1, in block 900, and detecting that the stacker is in a manual mode condition, in block 910, the system waits for a printing order via a user interface device, in block 915, and once the order is received it proceeds to the printing and outputting operations of P1, in block 920.

Such implementations may reduce the risk that a print job P1 that has to be printed in manual mode, sent by one user, is printed before the user is ready to have it printed. This may occur for example if a different user acts on the stacker (for example opens the top guide of the stacker in the case of FIG. 2 or of FIGS. 3*a* and 3*b*) for example just for removing previously printed plots.

Figure 10:
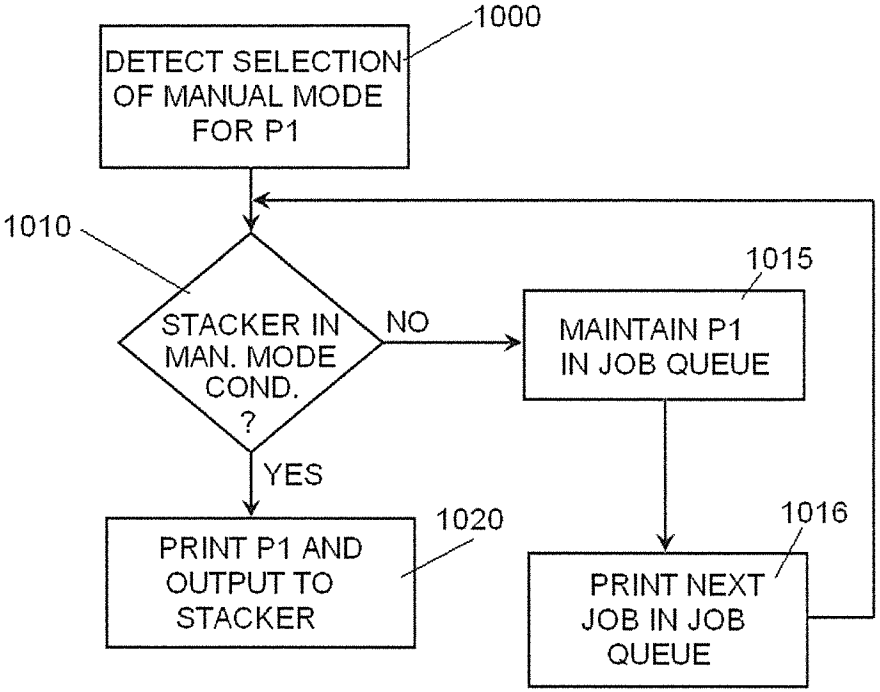

FIG. 10 illustrates some implementations of methods for printing wherein, after detecting that a manual mode is selected for a print job, said print job may be maintained in a job queue, and printing of later print jobs of the queue may be enabled, until it is detected that the stacker is in a manual mode condition.

For example, as shown in FIG. 10, after detecting that a manual mode is selected for print job P1, in block 1000, the system may proceed to verify if the stacker is in a manual mode condition, in block 1010. In the affirmative, the system may proceed to block 1020, wherein the print job P1 may be printed and outputted to the stacker.

If verification in block 1010 is negative, the system may proceed to block 1015 wherein it may maintain the print job P1 in a job queue, without printing it, and to block 1016, wherein it may print the next print job available in the job queue, before returning to the verification block 1010.

In implementations such as the example of FIG. 10, after a user sends a print job P1 to be printed in manual mode, print jobs that have been sent later and are therefore placed later in a job queue may be outputted to the stacker and do not need to be held up until the user of the print job P1 is ready to put the stacker in manual mode.

Figure 11:
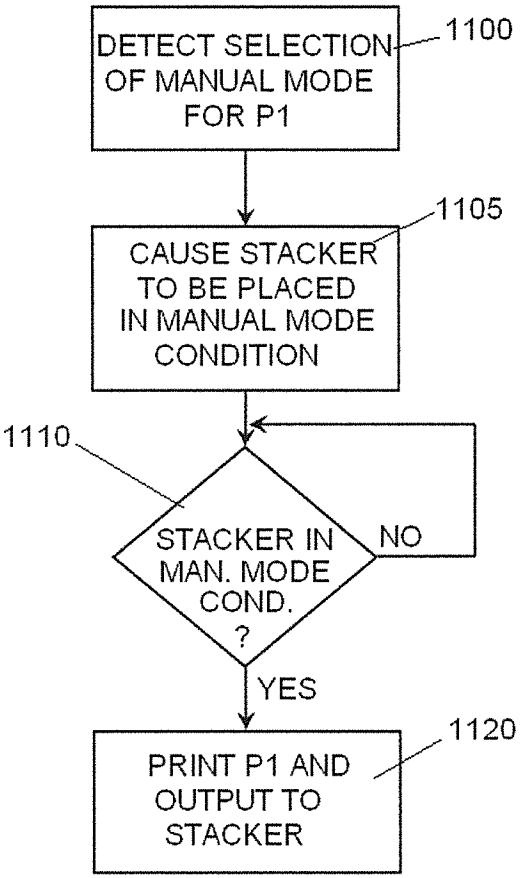

FIG. 11 illustrates in a flowchart further examples of methods for printing as disclosed herein. In FIG. 11, implementations of a method for printing may comprise detecting that a manual mode is selected for a print job in block 1100, and thereafter, in block 1105, causing a stacker to be placed in a manual mode condition, in which one side of a media advance path is free from media contacting elements. Causing the stacker to be placed in manual mode condition may be done for example by issuing a request to a user, or by directly acting on the stacker.

Verification may be then performed in block 1110 of whether the stacker is in manual mode condition. In case of positive verification, the print job may be printed and outputted to the stacker, in block 1120. Otherwise, the system may return to block 1110 for a new verification.

Steps of implementations and examples described above may be combined in further particular implementations of methods for printing.

For example, some implementations may involve a combination of steps described in any of FIGS. 6 to 11, such as for example issuing a request to move the stacker to a manual mode condition as illustrated in FIG. 6, and waiting for a printing order via a user interface device, as described in relation with FIG. 9.

In other examples, the steps described in relation with any of FIGS. 6 to 11 may be used in further implementations additionally involving for example steps disclosed in FIG. 5.

The present disclosure is also related to printing systems comprising a controller to perform implementations of the methods for printing as disclosed herein.

Some implementations of such a stacker may be as illustrated in FIG. 1, 2, or 3*a* and 3*b*.

Implementations of such printing systems may comprise a controller 300 and a stacker, such as for example stacker 10 (FIG. 1) or stacker 110 (FIG. 2) or stacker 210 (FIGS. 3*a* and 3*b*). The stacker may have media contacting elements in order to guide the print media on both sides of a print media advance path. Some examples of media contacting elements may be stacker support 12 and top guide 13 of stacker 10 of FIG. 1, or stacker support 112 and top guide 113 with top guide elements 121 of stacker 110 of FIG. 2, or stacker support 212 and top guide 213 with top guide elements 221 of stacker 210 of FIGS. 3*a* and 3*b*.

In some implementations, the stacker may be movable to a manual mode condition, such as for example that depicted in ghost lines in FIG. 2 or that depicted in FIG. 3*b*, in which one side of the media advance path is free from media contacting elements.

In implementations as disclosed, high quality plots may be printed, for example on photographic paper, and outputted to stacker 110. When the user sends a print job P1 to be printed in manual mode, the system may wait for the top guide 113 of the stacker 110 to be opened by the user. Then it may print the print job P1 and output it to the open stacker 113, such that its printed side is not contacted by guiding elements. The system may then pause subsequent jobs in a job queue, so as to avoid damaging the print job P1 just printed, until the user takes further action, for example until the user removes the print job P1.

Implementations of printing systems with different physical configurations of the stacker and the media contacting elements thereof are also possible.

Depending on the configuration of the stacker, the manual mode condition may be different from that shown in FIG. 2 or 3*b*: it may involve for example bringing one portion of the stacker away from the media path, and/or completely withdrawing one portion of the stacker, and/or displacing individual guiding elements such as wheels or rollers, or groups thereof, away from the media path, and/or other.

According to some implementations, the system may comprise a sensor, such as for example sensor 310 in FIG. 2, to detect that the stacker is in the manual mode condition.

Although only a number of particular implementations and examples have been disclosed herein, further examples may be derived through combinations, variations or modifications of the described elements. In particular, implementations of methods and printing systems may involve some of the steps or features described and not others, and may also involve additional steps or features.

The invention claimed is:

1. A method for printing, comprising:

receiving a print job to generate a printed media;

detecting a selection of a manual mode for the print job;

in response to detecting the selection of the manual mode, determining, from a sensor, whether a user has moved a top guide of a stacker into a manual mode condition, wherein the top guide is to contact the printed media while in a normal operating condition and to be spaced from the printed media while in the manual mode condition;

in response to a determination that the top guide of the stacker has not been manually moved to the manual mode condition, delaying performance of the print job and allowing a separate outputting operation to perform;

in response to a determination that the top guide of the stacker has been manually moved to the manual mode condition, printing the print job to generate the printed media; and outputting the printed media to the stacker, such that the printed media is positioned between a backside support of the stacker and the top guide, wherein the backside support extends along a plane in a direction in which the printed media is outputted, and wherein, in the normal operating condition, the top guide extends parallel to the plane and has a major surface that extends alongside a major surface of the backside support and in the manual mode condition, the top guide extends at an angle with respect to the plane.

2. The method of claim 1, further comprising, after printing the print job and outputting the printed media to the stacker, pausing output of a further printed media to the stacker until a predetermined external action is detected.

3. The method of claim 2, wherein the predetermined external action comprises an action selected from a withdrawal of printed media from the stacker, a reversal of the manual mode condition of the stacker, an order via a user interface device to end the manual mode, or a combination thereof.

4. The method of claim 2, further comprising issuing a warning that the stacker is in the manual mode condition if a predetermined time lapses after the print job is printed and the printed media is outputted to the stacker, and the predetermined external action is not detected.

5. The method of claim 1, further comprising, after printing the print job and outputting the printed media to the stacker, pausing output of a further printed media to the stacker until a predetermined delay has lapsed.

6. The method of claim 1, further comprising, after printing the print job and outputting the printed media to the stacker, pausing printing a further print job until a predetermined external action is detected.

7. The method of claim 1, wherein detecting the selection of the manual mode for the print job comprises detecting the selection of the manual mode from a user via a user interface device.

8. The method of claim 1, wherein detecting the selection of the manual mode for the print job comprises associating a predetermined kind of print media with the manual mode, and detecting the selection of the predetermined kind of print media for the print job.

9. The method of claim 1, further comprising issuing a request to a user to move the stacker to the manual mode condition, after detecting the selection of the manual mode for the print job.

10. The method of claim 1, wherein after detecting the selection of the manual mode for the print job, the method comprises maintaining said print job in a job queue and enabling printing later print jobs in the queue, until it is detected that the stacker is in the manual mode condition.

11. The method of claim 1, further comprising moving the stacker to a manual mode condition, after detecting the selection of the manual mode for the print job.

12. The method of claim 1, wherein detecting that a stacker is in a manual mode condition further comprises detecting that guiding elements of the stacker for contacting and guiding the printed side of printed media on the top guide are spaced apart from a print media advance path through the stacker.

13. The method of claim 12, wherein detecting that the to guide is spaced apart from the print media advance path further comprises detecting that the top guide of the stacker, which bears the guiding elements, is in the manual mode condition, wherein the manual mode condition is an open position.

14. The method of claim 1, further comprising waiting for a printing order from a user via a user interface device before printing the print job.

15. A method for printing, comprising:

receiving a print job to generate a printed media;

detecting a selection of a manual mode for the print job;

in response to detecting the selection of the manual mode, determining, from a sensor, whether a user has moved a top guide of a stacker into a manual mode condition, wherein the manual mode condition is a condition in which one side of a media advance path is free from media contacting elements on the top guide, wherein the media contacting elements of the stacker include a backside support positioned opposite the top guide, and wherein a normal operating condition is a condition in which the printed media is to contact the media contacting elements on the top guide;

in response to a determination that the top guide of the stacker has not been manually moved to the manual mode condition, delaying performance of the print job and maintaining a job queue to allow a later print job to be outputted before the print job if the later print job is not selected for manual mode;

in response to a determination that the top guide of the stacker has been manually moved to the manual mode condition, printing the print job to generate the printed media; and outputting the printed media to the stacker such that the printed media is positioned between the backside support and the top guide, wherein the backside support extends along a plane in a direction in which the printed media is outputted, and wherein, in the normal operating condition, the top guide extends parallel to the plane and has a major surface that extends alongside a major surface of the backside support and in the manual mode condition, the top guide extends at an angle with respect to the plane.

16. A printing apparatus comprising:

a stacker comprising:

a to guide; and media contacting elements including a backside support positioned opposite the top guide; and a controller to:

detect a selection of a manual mode for a print job;

in response to a detection that the manual mode has been selected, determine whether a user has moved the top guide of the stacker into a manual mode condition, wherein a normal operating condition is a condition in which a printed media is to contact the media contacting elements on the top guide;

in response to a determination that the top guide of the stacker has not been manually moved to the manual mode condition, cause the printing apparatus to delay performance of the print job and maintain a job queue to allow a later print job to be outputted before the print job if the later print job is not selected for manual mode;

in response to a determination that the top guide of the stacker has been manually moved to the manual mode condition, cause the printing apparatus to print the print job to generate the printed media, and cause the printing apparatus to output the printed media to the stacker such that the printed media is positioned between the backside support and the top guide, wherein the backside support extends along a plane in a direction in which the printed media is outputted and wherein, in the normal operating condition, the top guide extends parallel to the plane and has a major surface that extends alongside a major surface of the backside support and, in the manual mode condition, the top guide extends at an angle with respect to the plane.

17. The printing apparatus of claim 16 further comprising a sensor to detect that the stacker s in the manual mode condition.

* * * * *